US009423220B2

(12) United States Patent
Pedersen

(10) Patent No.: US 9,423,220 B2
(45) Date of Patent: Aug. 23, 2016

(54) METHOD AND APPARATUS FOR INCREASING THE VISIBILITY OF AN ARROW UTILIZING LIGHTED FLETCHINGS

(71) Applicant: Out RAGE, LLC, Cartersville, GA (US)

(72) Inventor: William E. Pedersen, Duluth, MN (US)

(73) Assignee: Out RAGE, LLC, Superior, WI (US)

( * ) Notice: Subject to any disclaimer, the term of this patent is extended or adjusted under 35 U.S.C. 154(b) by 0 days.

(21) Appl. No.: 14/833,773

(22) Filed: Aug. 24, 2015

(65) Prior Publication Data

US 2015/0362300 A1 Dec. 17, 2015

Related U.S. Application Data

(63) Continuation of application No. 13/998,211, filed on Oct. 11, 2013, now Pat. No. 9,151,580.

(51) Int. Cl.
*F42B 6/06* (2006.01)
*F42B 6/02* (2006.01)

(52) U.S. Cl.
CPC .... *F42B 6/06* (2013.01); *F42B 6/02* (2013.01)

(58) Field of Classification Search
CPC ..... F42B 6/06
See application file for complete search history.

(56) References Cited

U.S. PATENT DOCUMENTS

| | | | |
|---|---|---|---|
| 2,484,589 | A | 10/1949 | Richards |
| 2,887,319 | A | 5/1959 | Lay |
| 4,003,576 | A | 1/1977 | Carella |
| 4,305,588 | A | 12/1981 | Dodge |
| 4,340,930 | A | 7/1982 | Carissimi |
| 4,547,837 | A | 10/1985 | Bennett |
| D301,272 | S | 5/1989 | Barrow et al. |
| 4,856,792 | A | 8/1989 | Hardison |
| 4,900,037 | A | 2/1990 | Miller |
| 5,134,552 | A | 7/1992 | Call et al. |
| 5,154,432 | A | 10/1992 | Saunders |
| 5,306,020 | A | 4/1994 | Bolf |
| 6,123,631 | A | 9/2000 | Ginder |
| 6,364,499 | B1 | 4/2002 | Jones |
| 6,390,642 | B1 | 5/2002 | Simonton |
| 6,695,727 | B1 | 2/2004 | Kuhn |
| 6,736,742 | B2 | 5/2004 | Price et al. |
| 7,021,784 | B2 | 4/2006 | DiCarlo |
| 7,189,170 | B1 | 3/2007 | Korsa et al. |
| 7,211,011 | B1 | 5/2007 | Sutherland |
| 7,374,504 | B2 | 5/2008 | Palomaki et al. |
| 7,837,580 | B2 | 11/2010 | Huang et al. |

(Continued)

FOREIGN PATENT DOCUMENTS

| | | | |
|---|---|---|---|
| FR | 2777647 | A1 | 10/1999 |
| GB | 2320207 | A | 6/1998 |

OTHER PUBLICATIONS

Archery Talk—Archers Helping Archers Forum: "Homemade Stuff?", http://www.archerytalk.com/vb/showthread.php?t=201870 &page=48&p=5786267 (2007).

(Continued)

*Primary Examiner* — John Ricci
(74) *Attorney, Agent, or Firm* — Covington & Burling LLP; Gregory S. Discher; Grant D. Johnson

(57) ABSTRACT

The visibility of an arrow after it has been fired is increased by illuminating arrow fletchings in which light injected into the nock is further injected into the fletchings.

16 Claims, 10 Drawing Sheets

(56) References Cited

U.S. PATENT DOCUMENTS

| | | | |
|---|---|---|---|
| 7,862,457 | B1 | 1/2011 | Urcheck |
| 7,927,240 | B2 | 4/2011 | Lynch |
| 7,931,550 | B2 | 4/2011 | Lynch |
| 7,993,224 | B2 | 8/2011 | Brywig |
| 8,123,636 | B1 | 2/2012 | Temprine |
| D664,625 | S | 7/2012 | Minica |
| 8,257,208 | B2 | 9/2012 | Harding |
| D669,955 | S | 10/2012 | Minica |
| D669,956 | S | 10/2012 | Minica |
| 8,342,990 | B1 | 1/2013 | Price |
| 8,540,594 | B2 | 9/2013 | Chu |
| 8,622,855 | B2 | 1/2014 | Bednar et al. |
| 8,758,177 | B2 | 6/2014 | Minica |
| 8,795,109 | B2 | 8/2014 | Roman |
| 2002/0039939 | A1 | 4/2002 | Hartman |
| 2003/0166425 | A1 | 9/2003 | Sutherland et al. |
| 2009/0097239 | A1 | 4/2009 | Lynch |
| 2011/0218063 | A1 | 9/2011 | Hunt |
| 2012/0100942 | A1 | 4/2012 | Minica |
| 2013/0267359 | A1 | 10/2013 | Pedersen |
| 2014/0187362 | A1 | 7/2014 | Pedersen et al. |

OTHER PUBLICATIONS

Archery Talk—Archers Helping Archers Forum: "Homemade Stuff?", http://www.archerytalk.com/vb/showthread.php?t=201870&page=48&p=5791405 (2007).

Archery Talk—Archers Helping Archers Forum: "Homemade Stuff?", http://www.archerytalk.com/vb/showthread.php?t=201870&page=62&p=1056170361 (2009).

PCT International Search Report (PCT Article 18 and Rules 43 and 44) for PCT/US2013/076108, Mar. 13, 2014.

PCT Written Opinion of the International Searching Authority (PCT Rule 43bis.1) for PCT/US2013/076108, Mar. 13, 2014.

International Search Report from PCT/US2014/059723, Dec. 22, 2014.

Written Opinion of the International Search Authority from PCT/US2014/059723, Dec. 22, 2014.

International Search Report from PCT/US2014/059742, Dec. 22, 2014.

Written Opinion of the International Search Authority from PCT/US2014/059742, Dec. 22, 2014.

METHOD AND APPARATUS FOR INCREASING THE VISIBILITY OF AN ARROW UTILIZING LIGHTED FLETCHINGS

RELATED APPLICATIONS

This application is a continuation of U.S. patent application Ser. No. 13/998,211, filed on Oct. 11, 2013, the entire contents of which is incorporated herein by reference.

FIELD OF THE INVENTION

This invention relates to increasing the visibility of an arrow after it has been fired by illuminating the fletchings of the arrow.

BACKGROUND OF THE INVENTION

As described in U.S. Pat. Nos. 4,340,930; 6,364,499; 7,021,784; 7,837,580; 7,927,240; 7,931,550; and 7,993,224, what is shown is the utilization of lighted nocks to find an arrow once it has been fired. Note further that a related case, U.S. Pat. No. 8,758,177, also describes a prior art nock light and assembly.

In addition to the above-mentioned patents there is a product brand called Nockturnal® manufactured by the Assignee hereof in which a lighted nock is actuated upon firing to inject light into the nock itself.

The problem is there is insufficient light to be able to see the nock under all conditions, especially for instance when the arrow goes into a leaf pile. The reason is that the light from these nocks are primarily transferred out the back of the nock and not significantly from the side.

Thus, in the past lighted nocks have been visible from the rear but not from the side and when they end up in the forest under leaves and the like they are often not retrievable because they cannot be seen from any distance, especially when the nock itself is obscured.

It will be appreciated that in the prior art nock lights include an LED assembly and battery which is secured within the arrow shaft or bolt in which the LED light has a hemispherical dome projecting into the transparent nock. In several of the above-mentioned patents the light is turned on or activated when the bow string presses against a plunger or pin which forces the LED assembly into contact with battery contacts to turn on the nock light. Other methods of turning the LED on also exist in prior art such as incorporating an accelerometer, or other subassembly motion caused by the string motion; all of which could be used with the innovations in this patent application to produce lighted fletchings.

SUMMARY OF INVENTION

In order to provide more visibility for an arrow that has been fired, the aforementioned nock lights inject light into translucent fletchings such that the light that is injected into the nock is also injected into a portion of the fletching. As a result the fletching not only projects light towards the back of the arrow in the direction of the hunter but also causes the fletchings to glow and thereby be visible.

The key to the subject invention is that the light from the nock is transmitted into the fletchings because they are mounted on the arrow shaft such that light from the LED enters a bottom edge of the fletching. Thus in one embodiment the fletchings are partially on top of the nock such that the trailing end of the fletchings is illuminated by nock illumination.

Also because it is not desirable to have too much light coming from the front of the fletchings, in one embodiment the fletchings are two piece fletchings that are co-molded. The forward portion of the two piece fletching is opaque or colored. The trailing edge of the forward portion has a parabolic shape for reflecting light back toward the rear clear piece of the fletching that then lights up for the hunter.

The interface between the opaque portion and the transparent portion of each of the fletchings is parabolic in one embodiment so that light that comes from the nock light goes into the fletching and is reflected back along the axis of the arrow or bolt so that it provides a brighter rear view for the hunter.

In one embodiment the LED light and battery assembly are contained at the trailing edge of the arrow adjacent a clear polycarbonate nock. In this embodiment the clear polycarbonate nock has a raised lip portion that physically engages a clear under edge of the fletchings so as to be able to transmit light from the LED injected into the lighted nock into the fletchings.

The fletchings in one embodiment are formed from a molded piece of clear urethane which has good light transmission capability but has also elastomeric properties such as to enable it to be press fit onto the polycarbonate nock to establish a robust interface between the polycarbonate nock and the urethane fletchings. As a result there is minimal light transmission lost across this interface.

While it is not required that the fletchings have an opaque or colored forward portion with a parabolic interface between the colored portion and the transparent portion, the fletchings themselves may be co-molded in two parts such that the rearward portion of the fletching is molded onto the forward portion of the fletching which is an opaque piece of urethane. In such a co-molded embodiment the trailing portion of the fletchings is clear and is optically transparent as possible a urethane fletching. In the comolding process the same tool may be utilized to establish threshold integrity between the opaque portion and the transparent portion of the fletching. The interface between the opaque portion at the front of the fletching and the clear piece at the back of the fletching functions to reflect light that is introduced into the fletching back along the axis of the arrow or bolt. Thus, any light that gets into the fletching reflects off the front opaque portion and is transmitted across the interface out the back of the fletchings.

Because the urethane utilized in the fletching does not have 100% optical transparency light will scatter within the fletching to cause a significant amount to come out the side of the fletching as fletching glow as well as exiting from the rear of the fletching.

The result is that not only is a large majority of the light transmitted back towards the hunter so that he can see where his arrow has landed, the light is also scattered to the side causing the fletchings to exhibit a glow which is readily visible from all angles when a hunter is looking for his arrow.

Note that when the light emitted diodes are utilized, the LED lamps typically have a hemispherical cover. There is also an annulus in the nock that extends out from the nock, such that any light that comes out of the hemisphere goes straight back through the nock and also goes sideways through the annular portion of the nock in an orthogonal direction. Thus light is injected into the clear nock and goes into the fletching at the rear portion of the fletching thus to inject light into the fletching. While a hemispherical light cover is not required to enable light transmission into the fletchings and nock, it is one embodiment that can achieve such function. Other shapes of light cover could be used as well, as long as they allow light to transmit both to the rear and the sides of the nock to allow simultaneous lighting of fletchings and nock.

A hemispherical light cover is the preferred embodiment because the LED in essence produces a ring of light at the nock, with a portion of the fletching on top of the ring.

One of the unique characteristics is that the fletching simply extends back onto the nock, with the majority of the fletching still forward on the arrow. Thus there is no contact between the majority of the fletching and the nock. The overlap in one embodiment is approximately one-fifth of an inch which is enough to take light that is propagating into the nock barrel and transmit it into the overlying edge of the fletching.

The result is that while a large portion of the light exits the nock in the usual fashion, since the fletchings are not 100 percent transparent not all of the light is transmitted out the end of the nock but rather into the fletchings which results in a glowing fletching.

When the parabolic interface is utilized between opaque portion and transparent portions of the fletching a significant amount of the light is refracted and bent and bounced around inside the fletching such that a not small amount of the light exits the side of the fletching causing the fletching to glow and therefore be perceivable by the hunter.

In summary, an arrow or bolt is provided with a LED battery-powered module in which the light from the LED is transmitted up into transparent fletchings whereupon the fletching are made to glow from the side as well as to provide a large amount of light back towards the hunter along the axis of the arrow.

BRIEF DESCRIPTION OF THE DRAWINGS

These and other features of the subject invention will be better understood in connection with the Detailed Description, in conjunction with the Drawings, of which.

DETAILED DESCRIPTION

Figure 1A:
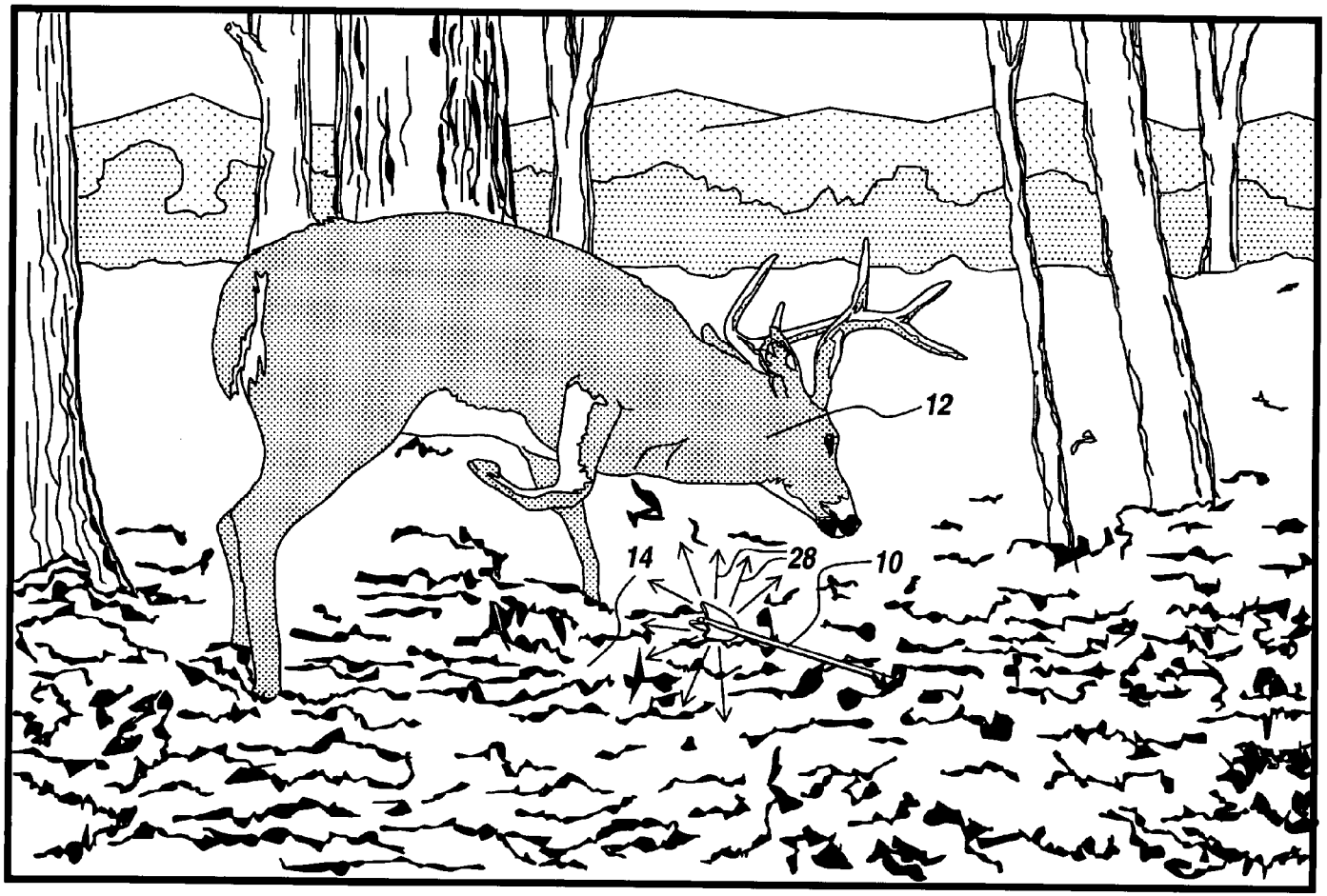
FIG. 1A is a diagrammatic representation of an arrow buried in leaves after having been fired at a deer, wherein in FIG. 1B a light emitting diode within the arrow illuminates the fletchings such that they glow due to an overlap between the bottom edge of the fletchings and an associated lighted nock.
Figure 1B:
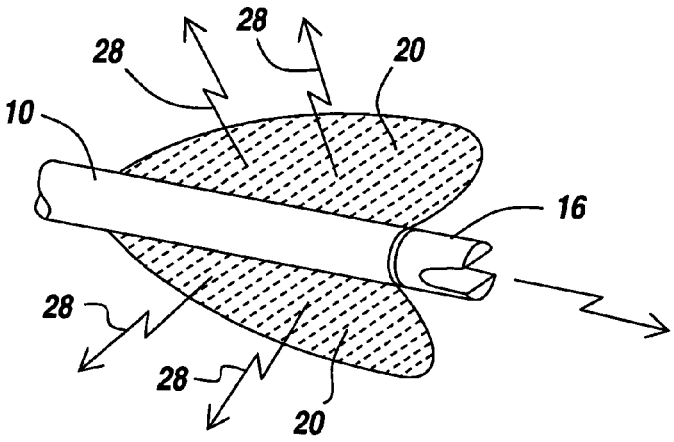

Referring now to FIG. 1A, an arrow 10 is shown having been fired at an animal 12 which has missed the animal and lies in the underbrush or leaves 14 that are obscuring the arrow 10 from view of the hunter. The arrow 10 as illustrated in FIG. 1B is provided with a lighted nock 16 which is only visible over a small angle directly behind the arrow 10 such that the arrow 10, which may be hidden by the underbrush or leaves 14, is not visible to the hunter and is therefore not subject to retrieval. On the other hand the fletchings 20 of the arrow 10 are lighted from light injected into the nock 16 so that they are extremely visible.

Referring to FIG. 1B, arrow 10 is provided with lighted fletchings 20 that overlie lighted nock 16 and which glow when the lighted nock 16 is actuated. This glow 28 is visible not only from the rear but also from the sides of the arrow 10 making the arrow 10 visible from all angles so that the arrow 10 may be retrieved.

Figure 2:
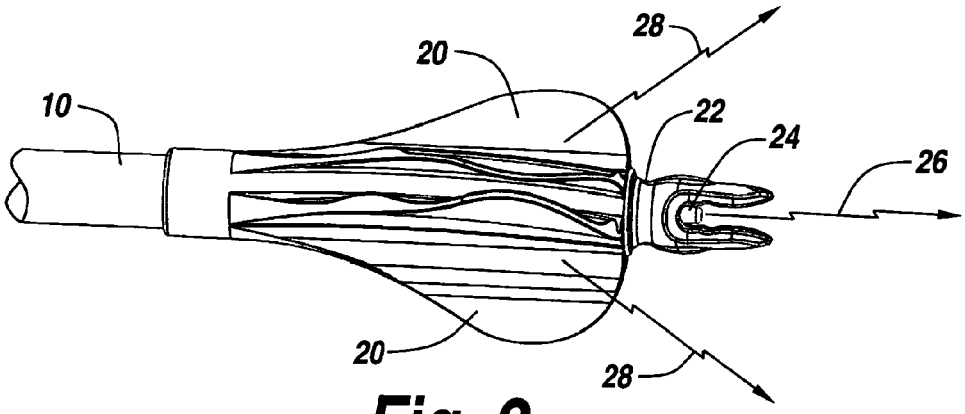
FIG. 2 is a diagrammatic illustration of the arrow of FIG. 1 in which light from an internally carried LED is injected into the fletchings.

Referring to FIG. 2, what can be seen is that arrow 10 is provided with transparent fletchings 20 that are affixed over a lighted nock 22 which has a plunger 24 to activate the internally carried battery/LED assembly as is common. Here it will be appreciated that nock 22 is lighted so that the light from the nock 22 is visible from the rear of arrow 10 as illustrated by arrow 26. Simultaneously light which is refracted within the fletchings 20 is directed outwardly as illustrated at 28 so that the fletchings 20 are made visible from the side of the arrow 10 in terms of a glow. While FIG. 2 shows an embodiment with a plunger style lighted nock activation, other means of activating the LED light such as an accelerometer or movable subassembly would serve equally well in this case. Any means used to light the nock 22, can be used to light the fletching 20 by having them overlap and transmit light between them. Alternatively, if the light is either molded into the fletching 20, or placed directly into the fletching 20, light from the fletchings 20 could be transmitted to the nock 22 and therefore light the nock 22. Lastly, it will be apparent that both the fletchings 20 and nock 22 could have a lighting source as well.

Figure 3:
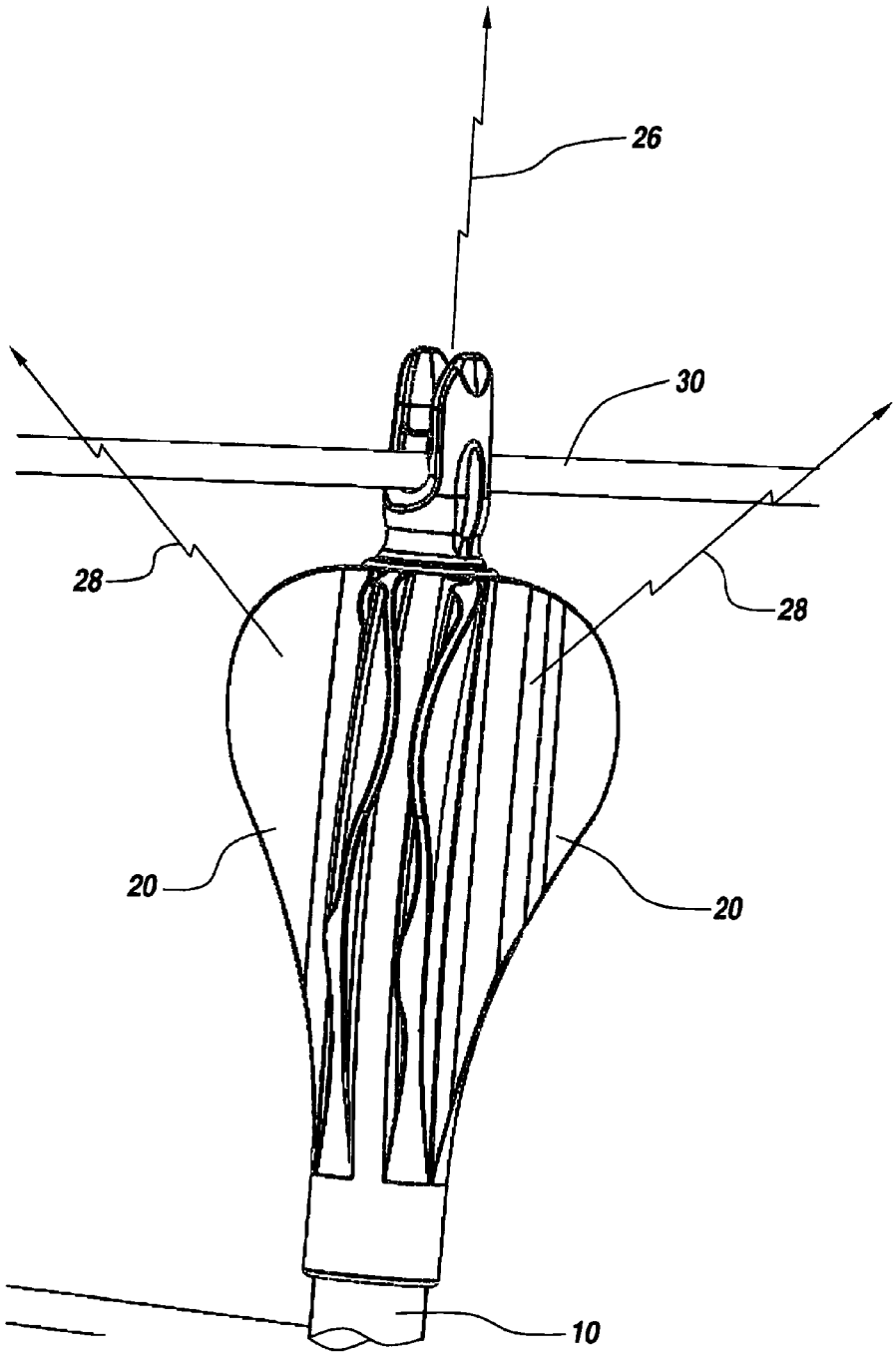
FIG. 3 is a diagrammatic illustration of the lighted fletchings of FIG. 2 in which a bow string activates the internally carried LED through a plunger assembly that turns on the LED.

This is more clearly shown in FIG. 3 in which as light 28 is visible to the side of the arrow 10 after the arrow light emitting battery module has been activated when bow string 30 depresses pin 24 of FIG. 2. For the other embodiments that do not have a piston, or plunger 24, the motion of the string 30 can be used to turn the light on in their respective fashions. In another embodiment the light is turned on prior to engagement with the string 30. In other words, the light activation and de-activation need not be controlled by the string 30 and could be independently controlled. The key to the subject invention is that both the fletchings 20 and the nock 22 would be lit, preferably, but not necessarily, from one light source; and preferably, but not necessarily, string activated.

Figure 4:
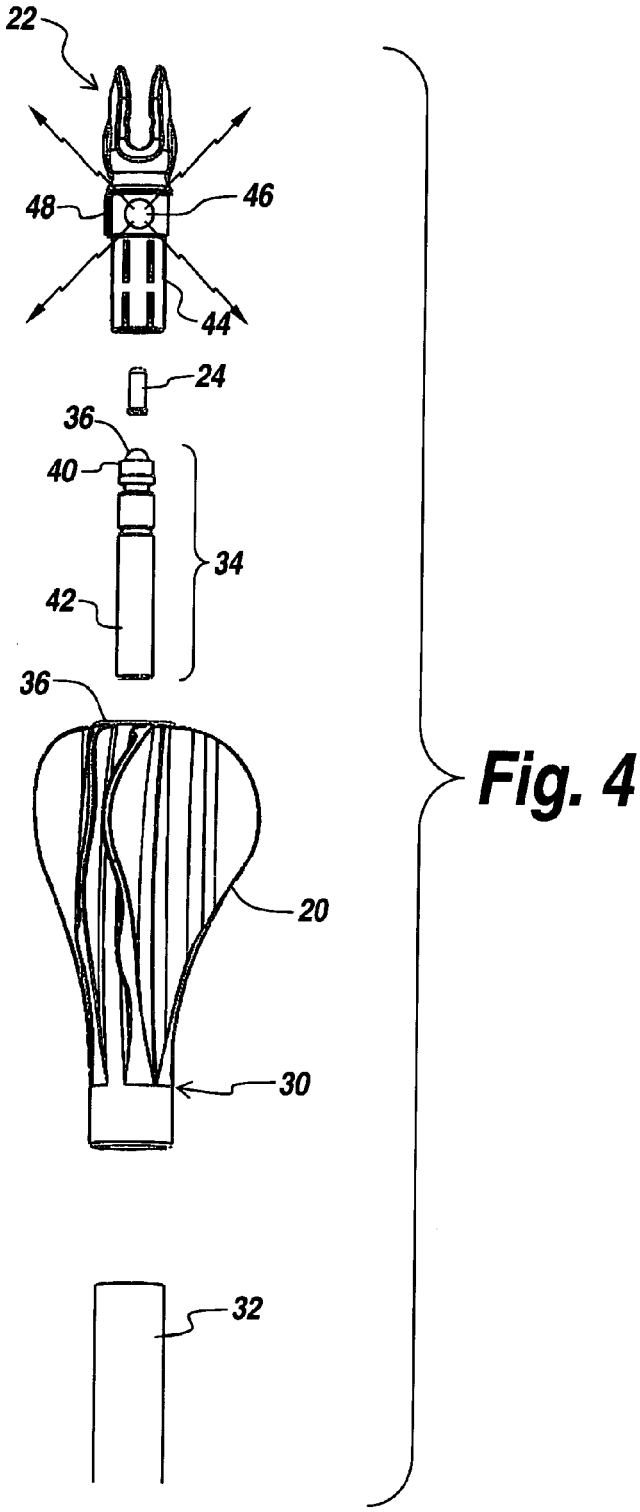
FIG. 4 is an exploded view of the lighted fletching of FIGS. 1-3 illustrating that the fletching overlies the battery/LED assembly, also showing a pin which pushes on the LED to connect the LED to the battery, also showing an aperture in the nock which permits transmission of the light from the LED into the fletchings.

Referring to FIG. 4, an exploded view of the lighted fletching assembly is illustrated in which a cylindrical carrier 30 is slipped over arrow shaft 32, with a battery LED assembly 34 slipped within a cylindrical channel 36 on which fletchings 20 are carried. An activation pin, here shown at 24 contacts dome 36 of LED 40 to connect LED 40 to battery 42. Assembly 34 is contained within a sleeve 44 of lighted nock 22, with lighted nock 22 being provided with a number of holes or orifices 46 about the periphery of nock shaft 48. In this way light which is omitted from dome 36 exits orifices 46 and is injected into the trailing edges of the fletchings 20. Nock 22 need not have holes 46 in its periphery if nock 22 is made of transparent or semi-transparent material such as polycarbonate, or clear ceramic. When nock 22 is made of transparent material, light from the LED subassembly 34 transmits through the nock body into the overlapping cylindrical carrier 30 and hence into fletchings 20.

Figure 5:
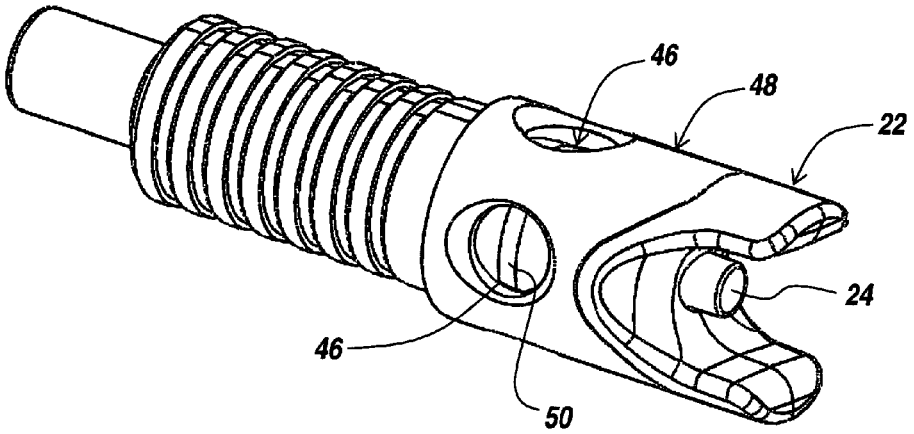
FIG. 5 is a diagrammatic illustration of the completed lighted fletching assembly of FIG. 4 illustrating one embodiment in which apertures in the nock permit light from a lighted ring within the nock to exit into the fletchings.

Referring now to FIG. 5, what is shown is the structure used in crossbow applications in which a nock is surrounded by a metal cylinder to prevent nock fracture during bow string slap. Here orifices 46 are provided through a metal support 48 for nock 22. It will be seen that nock 22 is provided with an annulus 50 which captures the light from a dome shaped LED and transmits it through orifices 46 into the trailing edge of overlying fletchings.

Figure 6:
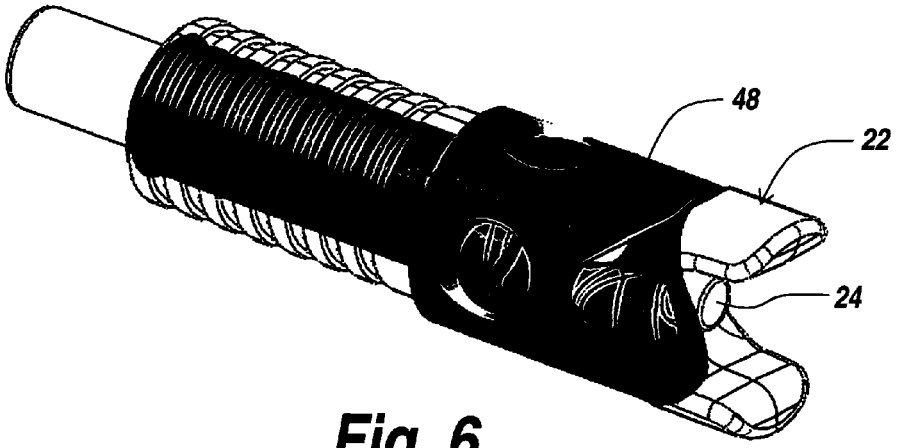
FIG. 6 is a diagrammatic illustration of one embodiment of a nock utilizable for crossbows in which the crossbow bolt is provided with the assembly of FIG. 4, but with a metal retaining system utilized to secure and control the lighted nock such that upon impact of the crossbow string the nock is not shattered.

As shown in FIG. 6, when a lighted nock 22 is to be provided for a crossbow, a metal support 48 can be used to surround lighted nock 22 to prevent the nock 22 and associated assemblies from shattering due to the close to 7000 psi that is exerted on the nock 22 when a crossbow is fired.

FIGS. 5 and 6 are another embodiment that is suitable for some models of crossbow. Any style of crossbow nock would be suitable, so long as light is transmitted from the nock body either directly or via openings to the fletchings. Alternatively, light could be generated in the fletchings and transmitted to the nock, or light could be generated in both. The preferred embodiment would be to light the nock and transmit light to the fletchings.

Figure 7:
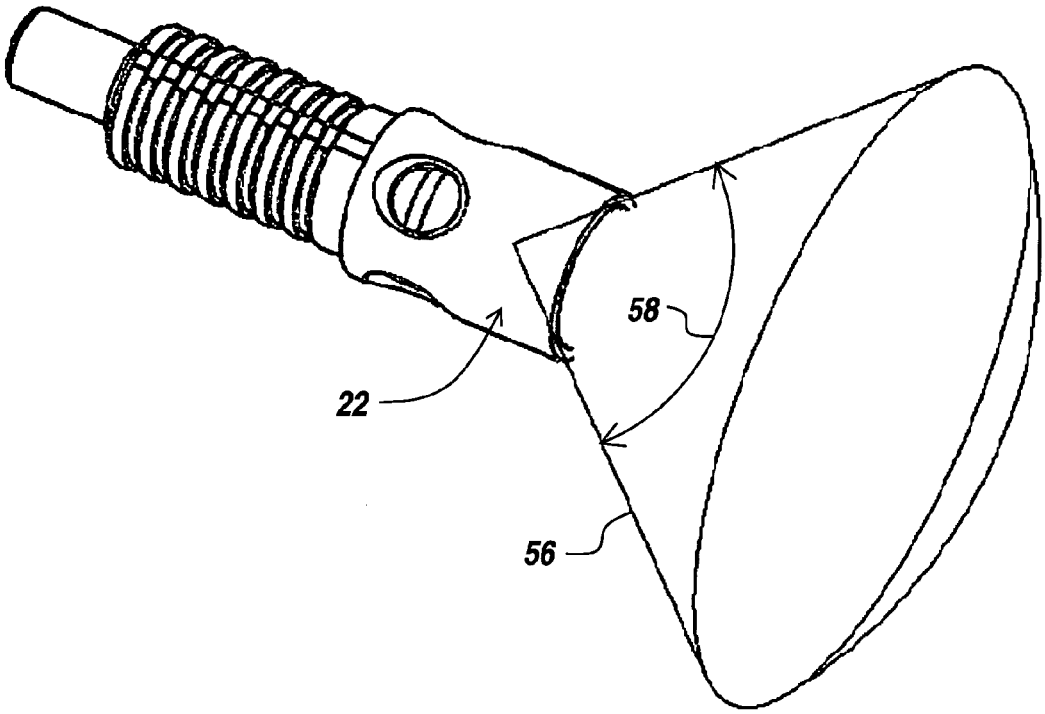
FIG. 7 is a diagrammatic illustration of the radiation pattern from the rear of the lighted nock showing a subtended angle of about 90 degrees; with additional light transmitted from side apertures to illuminate the fletchings and therefore increase the angle from which the assembly would be readily visible.

Referring to FIG. 7, the light emitted from the lighted nock 22 is shown to exit in a cone 56 that subtends an angle 58, for instance of 90 degrees. This cone 56, while being visible to a hunter who is directly aft of the arrow, is not easily seen when the arrow lands with its longitudinal axis facing away from the hunter. As noted above, light can be channeled to orifices or holes on the side of the nock 22 to an overlapping fletching assembly to then light the fletchings and therefore increase the angle 58 from which the assembly is visible.

Figure 8:
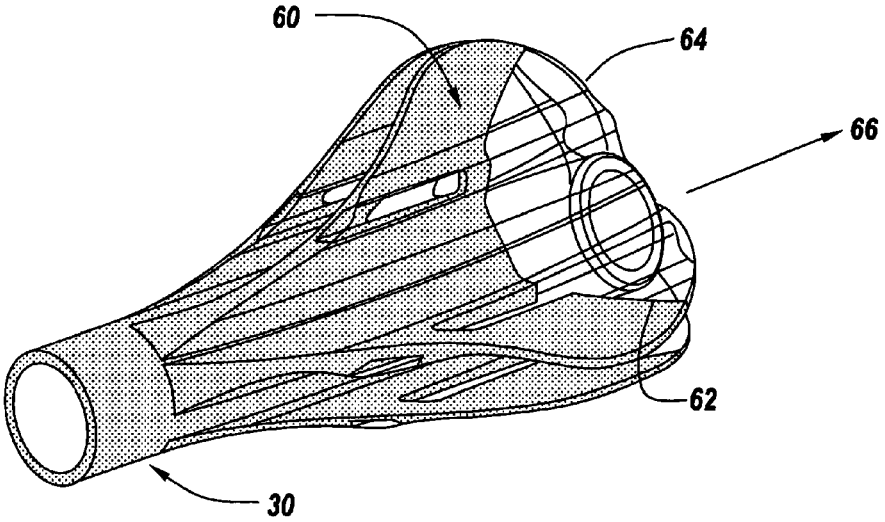
FIG. 8 is a diagrammatic illustration of the two part fletching assembly illustrating the opaque or colored portion of the fletching that provides a parabolic interface between the opaque and transparent portions of the fletching at the rear.

Referring now to FIG. 8, the fletching assembly 20 of FIG. 4 is shown in which the fletchings are mounted on cylindrical carrier 30, with the fletchings in this embodiment having two parts. The first part is the forward part 60 which is opaque or colored and has a parabolic rear interface surface 62 in one embodiment such that when the transparent rear portion 64 abuts the forward portion 60, light that enters the transparent rear portion 64 is reflected aft as illustrated by arrow 66 to the extent that light impinges upon parabolic interface 62. The interface 62 is not required to be parabolic and could suitably be made in any suitable shape or combination of shapes to reflect light primarily out the rear of the fletchings. This could include a hyperbola, a spherical, a surface trapezoid or other multi-faceted shape.

Figure 9:
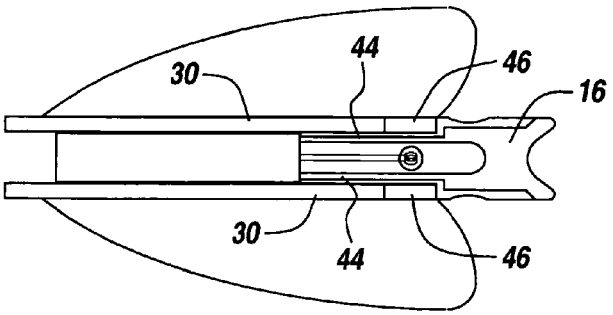
FIG. 9 is an exploded view of the system of FIG. 8 showing the lighted nock having an aperture which when inserted into a cylindrical channel in the fletching aligns the rearward portion of the fletching with the light emitted from the lighted nock, thus to illuminate the fletchings.

Referring to FIG. 9, the opaque portion 60 is shown with the preferably parabolic interface at 62 and with the transparent portions 64 of the fletchings clearly illustrated. Also shown is a nock extension 44 adapted to fit into cylindrical fletching assembly 30 which communicates with orifice 46 in lighted nock assembly extension 44 such that light from orifices 46 of FIGS. 4-6 enters into the lighted nock assembly when it is press fit into the cylindrical interior portion of assembly 30. As can be seen light 76 exiting orifice 46 bounces off the parabolic interface and is reflected back along the longitude center line of the arrow as illustrated at 78. If nock 16, nock assembly extension 44 and assembly 30 are made of transparent material, there need be no exit orifices from the nock, as light will escape from nock assembly extension 44 into the press fit transparent inner cylindrical portion of assembly 30 and thence into the fletchings.

Figure 10:
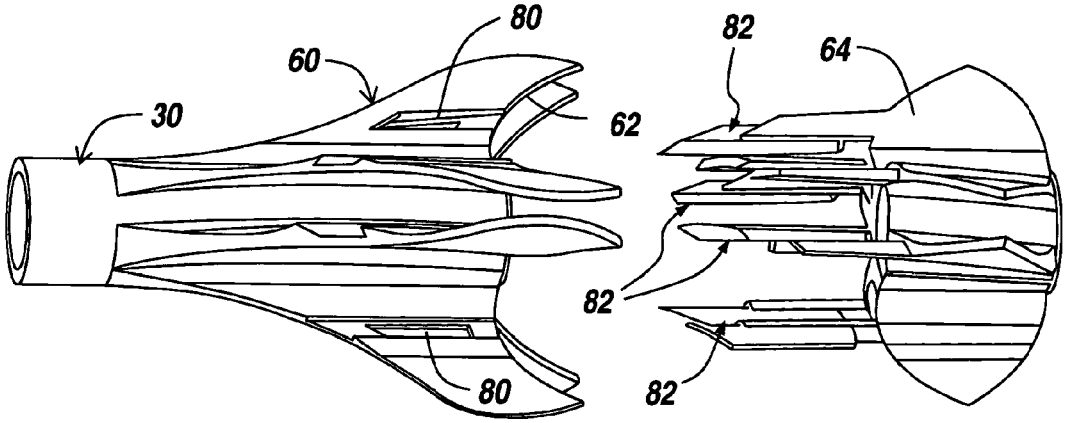
FIG. 10 is a diagrammatic illustration of the completed fletching nock light assembly of FIG. 9 in which light from the aperture enters the rearward portion of the fletchings and is reflected by the parabolic surface backwards towards the hunter as well as exiting to the side of the fletchings.

Referring to FIG. 10, when the two portions of the fletchings are joined together, namely portions 60 and 64, the preferably parabolic surface 62 is such that it reflects light from orifice 46 or annulus 70, back out along the center line of the arrow. The forward portion of the fletching 60 is preferably opaque to light, while the rear portion 64 is preferably transparent or nearly so. The two portions 60 and 64 can be mechanically and/or chemically bonded together. In the preferred embodiment, one portion is injection molded, followed by comolding or insert molding of that piece into a single unit in which both parts 60 and 64 are inherently and permanently bonded to one another.

In the assembly of the two part fletching, the forward part of the fletching 60 is illustrated having fletching portions 62 mounted to assembly 30, with the parabolic surfaces 62 extending aft and with slots 80 adapted to coact with corresponding pins 82 in the after section of the fletchings as will be described in connection with FIG. 12.

It can be seen that the aft section 64 slides into the forward section 60 in which pins 82 extend into slots 80 in the forward section 60 such that the aft section 64 is locked to the forward section 60. Here the aft section 64 is that into which light is injected causing fletching glow.

Figure 11:
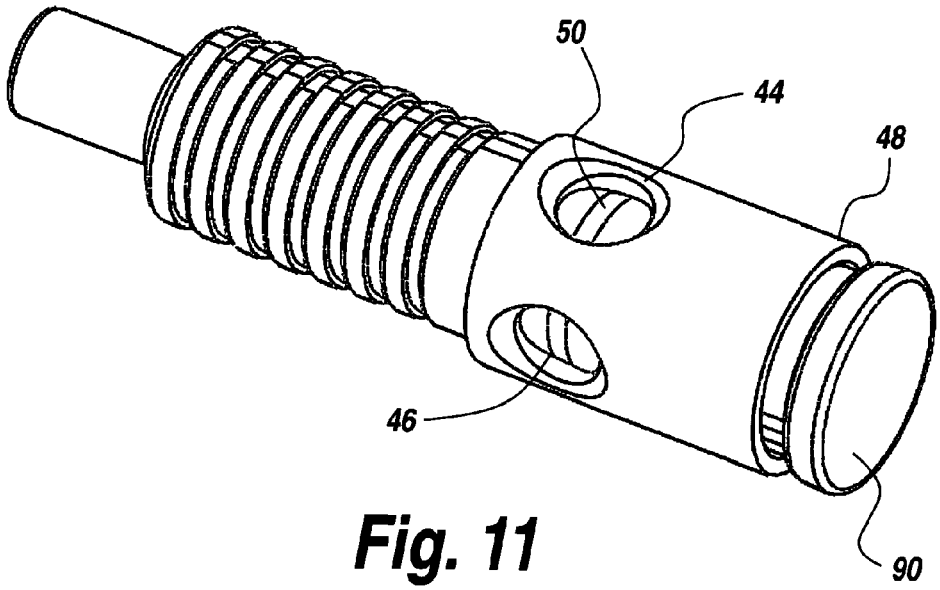
FIG. 11 is an exploded view of the interconnection of the forward portion of the fletchings which is opaque versus the transparent rear portion of the fletching, illustrating the interlocking connection between the two portions of the fletching.
Figure 12:
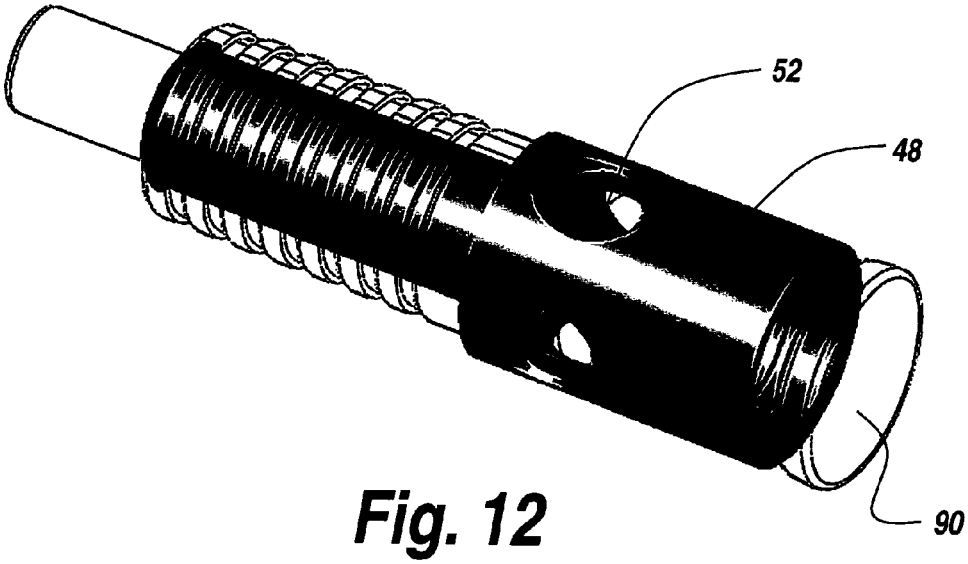
FIG. 12 is a diagrammatic illustration of a nock light assembly in which rather than having a notch in the nock, the nock is provided with a flat impact surface which nonetheless activates the internally carried nock light module to emit light around a ring beneath the apertures; with this embodiment being commonly used for crossbows.

Referring now to FIGS. 11 and 12, the subject lighted fletchings may be adapted for use in crossbow bolts by providing a flat surface 90 adapted to be contacted by the crossbow string which then propels the bolt forward, with the lighting of the fletchings accomplished as described above.

In FIGS. 5, 6, 11 and 12, for crossbows, light from the internally carried LED module exits annulus 50 through orifices 46 in support structure 48 into the fletchings, with structural rigidity and strength being added when support structure 48 is utilized to stabilize the nock against fracture during crossbow firing.

In FIGS. 11 and 12 the flat surface for the nock provides for secure firing of a bolt, while in FIGS. 5 and 6 a different style, often called a capture style crossbow nock is used. However, this system of a supporting nock structure transmitting light to the fletchings may be used either for a crossbow bolt or a conventional bow.

Figure 13:
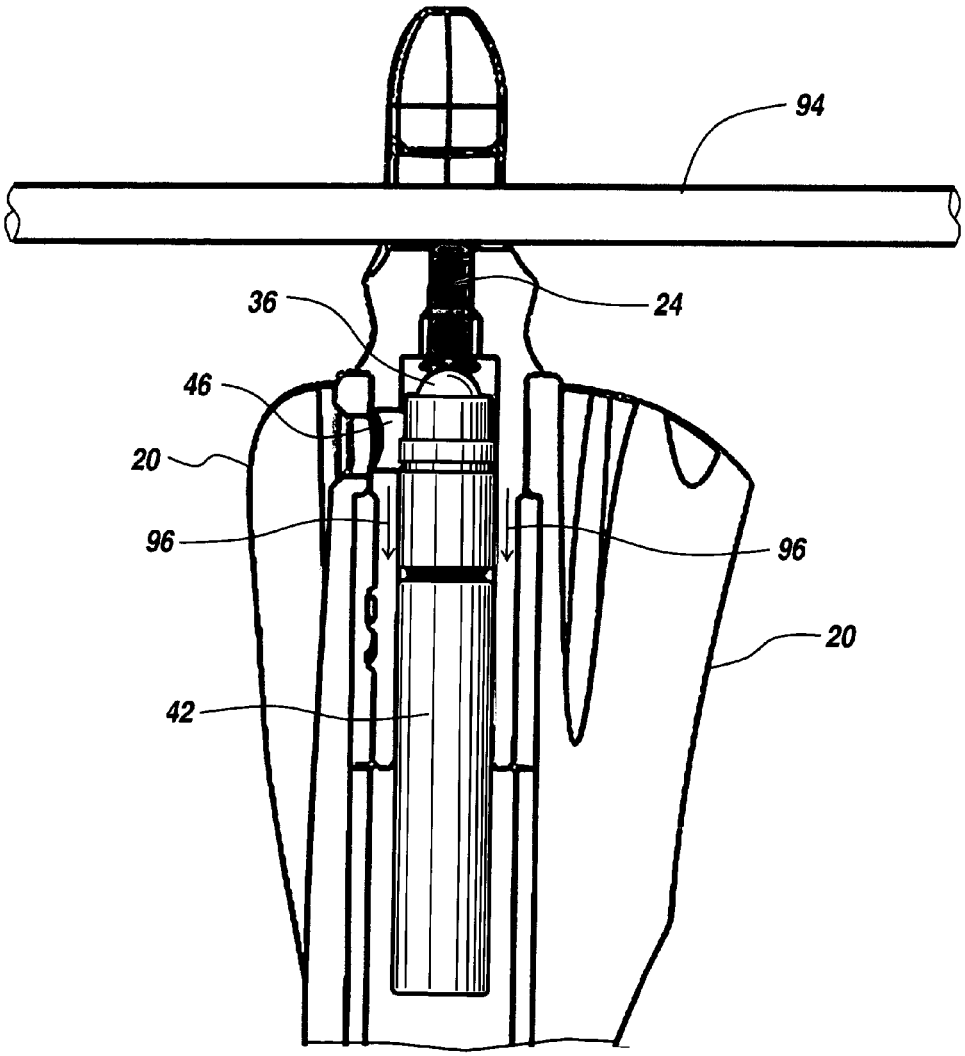
FIG. 13 is a diagrammatic illustration of the utilization of a pin actuated LED light assembly, with the pin depressed against the top of the dome of the LED to push the assembly forwardly upon impact with the bow string that in turn turns on the LED.

Referring now to FIG. 13, what is shown in cross section is how pin 24 is contacted with a bow string 94 to push dome 36 in the direction of arrows 96 to close a switch between the LED underneath the dome 36 and batteries 42. Here it can be seen that when the whole assembly is moved in the direction of arrows 96, light through orifice 46 enters into fletchings 20 through orifice 46.

As mentioned hereinbefore the fletchings themselves may be co-molded and made of a urethane which is transparent. If it is a two piece fletching, the opaque piece may be made of urethane, whereas the transparent piece is also made of urethane. Many suitable materials could be used for the leading vane portion such as vinyl, polyethylene, polyurethane or other materials that can be blended to be flexible. The trailing fletching material should be transparent or nearly so, so are more limited in material selection. Silicone blends, urethane blends, polycarbonate blends or acrylic blends would be the most likely candidate materials.

While the subject invention is described in terms of the use of urethane for the fletchings, it will be appreciated that any clear material for the fletchings is within the scope of the subject invention. Moreover, the fletchings can also be made out of synthetic feathers which also will light up with the introduction of light into the fletching.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An apparatus comprising:

an arrow;

translucent fletchings mounted on the arrow;

a light source configured to emit light into the translucent fletchings; and a lighted nock, wherein the light source is housed within the lighted nock, wherein the lighted nock comprises an opaque material, and wherein the lighted nock comprises orifices configured to emit light from the lighted nock.

2. The apparatus of claim 1, wherein the light source is molded into the translucent fletchings.

3. The apparatus of claim 1, wherein the lighted nock comprises a a metal support.

4. The apparatus of claim 1, wherein the translucent fletchings comprise a front portion, a rear portion, and an interface between the front portion and the rear portion.

5. The apparatus of claim 1, further comprising an accelerometer configured to activate the light source.

6. The apparatus of claim 1, further comprising a plunger configured to activate the light source.

7. An apparatus comprising:

an arrow;

translucent fletchings mounted on the arrow; and a light source configured to emit light into the translucent fletchings, wherein the translucent fletchings comprise a front portion, a rear portion, and an interface between the front portion and the rear portion, and wherein the shape of the interface between the front portion and the rear portion comprises a parabola, a hyperbola, a portion of a sphere, or a surface trapezoid.

8. The apparatus of claim 7, further comprising a lighted nock, wherein the light source is housed within the lighted nock.

9. The apparatus of claim 8, wherein the lighted nock comprises an opaque material.

10. The apparatus of claim 9, wherein the lighted nock comprises orifices configured to emit light from the lighted nock.

11. The apparatus of claim 8, wherein the lighted nock comprises orifices configured to emit light from the lighted nock.

12. An apparatus comprising:

an arrow;

translucent fletchings mounted on the arrow; and a light source configured to emit light into the translucent fletchings, wherein the translucent fletchings comprise a front portion, a rear portion, and an interface between the front portion and the rear portion, and wherein the front portion comprises vinyl, polyethylene, or polyurethane, and the rear portion comprises a silicone blend, a urethane blend, a polycarbonate blend, or an acrylic blend.

13. The apparatus of claim 12, further comprising a lighted nock, wherein the light source is housed within the lighted nock.

14. The apparatus of claim 13, wherein the lighted nock comprises an opaque material.

15. The apparatus of claim 14, wherein the lighted nock comprises orifices configured to emit light from the lighted nock.

16. The apparatus of claim 13, wherein the lighted nock comprises orifices configured to emit light from the lighted nock.

* * * * *